US009149820B2

(12) United States Patent
Becker et al.

(10) Patent No.: US 9,149,820 B2
(45) Date of Patent: Oct. 6, 2015

(54) REVERSIBLE AIR-ASSISTED AIRLESS SPRAY TIP

(75) Inventors: Steven D. Becker, Blaine, MN (US); Allonzo Baron Seran, III, Orono, MN (US); Jimmy Wing Sum Tam, Plymouth, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 1083 days.

(21) Appl. No.: 12/594,840

(22) PCT Filed: Apr. 3, 2008

(86) PCT No.: PCT/US2008/059288

§ 371 (c)(1), (2), (4) Date: Oct. 6, 2009

(87) PCT Pub. No.: WO2008/124520

PCT Pub. Date: Oct. 16, 2008

(65) Prior Publication Data

US 2010/0116902 A1 May 13, 2010

Related U.S. Application Data

(60) Provisional application No. 60/911,011, filed on Apr. 10, 2007.

(51) Int. Cl.
*B05B 15/02* (2006.01)
*F23D 11/34* (2006.01)
(Continued)

(52) U.S. Cl.
CPC ..... *B05B 7/0815* (2013.01); *B05B 7/0861* (2013.01); *B05B 15/0283* (2013.01)

(58) Field of Classification Search
CPC ..... B05B 15/0283; B05B 15/0815
USPC ..... 239/119, 112, 288.3, 288, 600, 104, 239/106, 290, 296, 300
See application file for complete search history.

(56) References Cited

U.S. PATENT DOCUMENTS 2,019,941 A 11/1935 Tracy
4,055,300 A 10/1977 Binoche
(Continued)

FOREIGN PATENT DOCUMENTS

CN 1349437 A 5/2002
DE 29622482 U1 2/1997
(Continued)

OTHER PUBLICATIONS

European Patent Office, European Search Report, Aug. 12, 2010, 6 pages.

*Primary Examiner* — Len Tran
*Assistant Examiner* — Alexander Valvis
(74) *Attorney, Agent, or Firm* — Kinney & Lange, P.A.

(57) ABSTRACT

The device (10) utilizes a standard reversible airless tip (12). The air cap (18) is provided with four air passages (20) which aim radially inwardly at 45° from the centerline of the housing (30). The passages (20) have a 12° angle from being perpendicular to the longitudinal axis (24) of the assembly (10). The four jets (20) provided by these passages are guided by four channels (28) in the surface of the housing (30) (also having the 12° ramp angle) so as to guide the air flow to the center of the oval orifice (14*a*) in the carbide (14). Two pairs of opposing air jets (22) are also provided in the air cap (18) directed perpendicularly to the fan (26) of paint or other atomized material and these jets (22) are angled at about 20.5° relative to the plane that is perpendicular to the longitudinal axis (24) of the assembly (10). Each pair is directed at one another and is spaced laterally from the longitudinal axis (24) to help in removing tails from the pattern.

6 Claims, 8 Drawing Sheets

(51) Int. Cl.

| | |
|---|---|
| ***F23D 11/38*** | (2006.01) |
| ***F23D 14/50*** | (2006.01) |
| ***B05B 1/28*** | (2006.01) |
| ***B05B 7/08*** | (2006.01) |

(56) References Cited

U.S. PATENT DOCUMENTS

| | | | | | |
|---|---|---|---|---|---|
| 4,219,157 | A | | 8/1980 | Binoche | |
| 4,349,153 | A | * | 9/1982 | Johnson | 239/105 |
| 4,386,739 | A | | 6/1983 | Kwok | |
| 4,508,268 | A | * | 4/1985 | Geberth, Jr. | 239/119 |
| 4,611,758 | A | * | 9/1986 | Geberth, Jr. | 239/119 |
| 4,618,098 | A | * | 10/1986 | Hedger et al. | 239/290 |
| 4,842,203 | A | | 6/1989 | Kuhn et al. | |
| 4,854,504 | A | * | 8/1989 | Hedger et al. | 239/294 |
| 5,080,283 | A | | 1/1992 | Kukesh et al. | |
| 5,435,491 | A | * | 7/1995 | Sakuma | 239/296 |
| 5,549,246 | A | | 8/1996 | Kukesh | |
| 5,704,548 | A | * | 1/1998 | Hedger et al. | 239/119 |
| 5,765,753 | A | * | 6/1998 | Kieffer | 239/119 |
| 5,887,793 | A | * | 3/1999 | Kieffer | 239/119 |
| 5,947,381 | A | * | 9/1999 | Carey | 239/119 |
| 6,655,606 | B2 | | 12/2003 | Earl | |
| 6,669,112 | B2 | | 12/2003 | Reetz, III et al. | |
| 6,874,708 | B2 | * | 4/2005 | Reetz, III | 239/575 |
| 6,918,546 | B2 | * | 7/2005 | Leisi | 239/119 |
| 7,059,545 | B2 | | 6/2006 | Reetz, III | |
| 2004/0262416 | A1 | * | 12/2004 | Micheli | 239/11 |

FOREIGN PATENT DOCUMENTS

| | | | |
|---|---|---|---|
| EP | 0804969 | A2 | 11/1997 |
| EP | 1445030 | A2 | 8/2004 |
| JP | 4265171 | A | 9/1992 |
| WO | 9809733 | A1 | 3/1998 |
| WO | 0103853 | A1 | 1/2001 |

* cited by examiner

REVERSIBLE AIR-ASSISTED AIRLESS SPRAY TIP

TECHNICAL FIELD

This application claims the benefit of U.S. Application Ser. No. 60/911,011, filed Apr. 10, 2007.

BACKGROUND ART

Reversible airless spray tips are well known and have long been popular. Air-assisted airless spray guns have also been popular but have generally not included the ability to reverse the tip for cleaning clue to the difficulty in routing the required air passages to the front of the tip.

DISCLOSURE OF THE INVENTION

The device of the instant invention utilizes a standard reversible tip such as Graco's FFT210. The air cap is provided with four air passages which aim radially inwardly and in the preferred embodiment are located 45° from the centerline of the housing. The passages have a 12° angle from being perpendicular to the longitudinal axis of the assembly. The four jets provided by these passages are guided by four channels in the surface of the housing (also having the 12° ramp angle) so as to guide the air flow to the center of the oval orifice in the carbide.

Two pairs of opposing air jets are also provided in the air cap directed perpendicularly to the fan of paint or other atomized material and these jets are angled at about 20.5° relative to the plane that is perpendicular to the longitudinal axis of the assembly. Each pair is directed at one another and is spaced laterally from the longitudinal axis to help in removing tails from the pattern.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
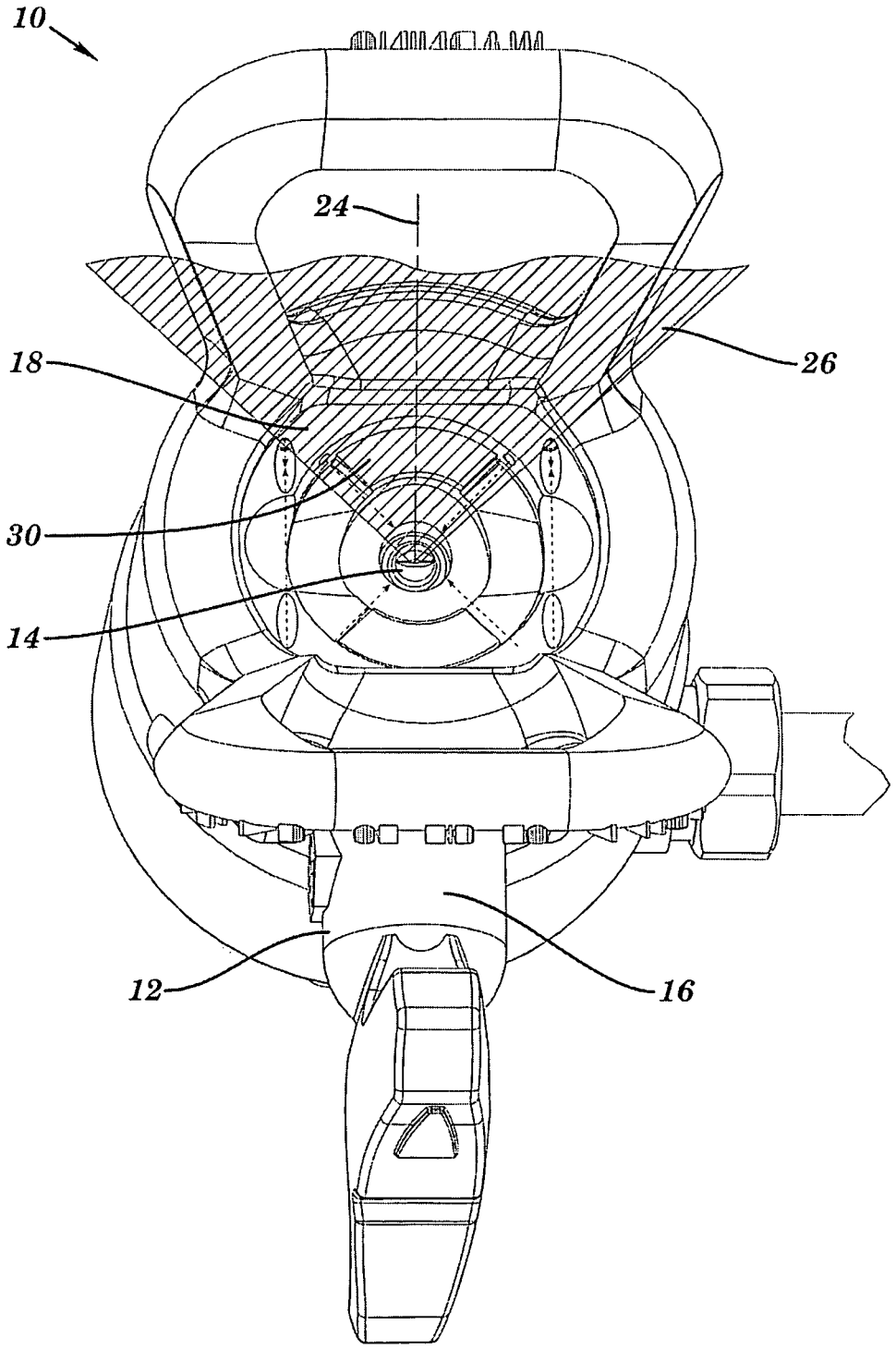
FIG. 1 is a front perspective view of the rip assembly of the instant invention.
Figure 2:
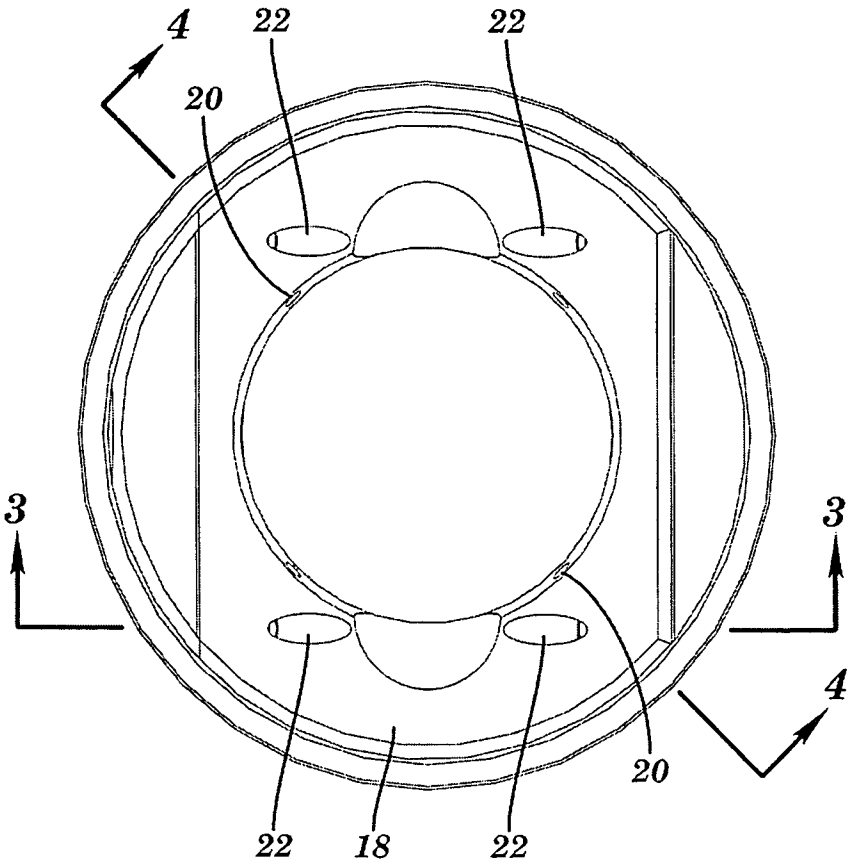
FIG. 2 is a front plan view of the air cap of the instant invention.
Figure 3:
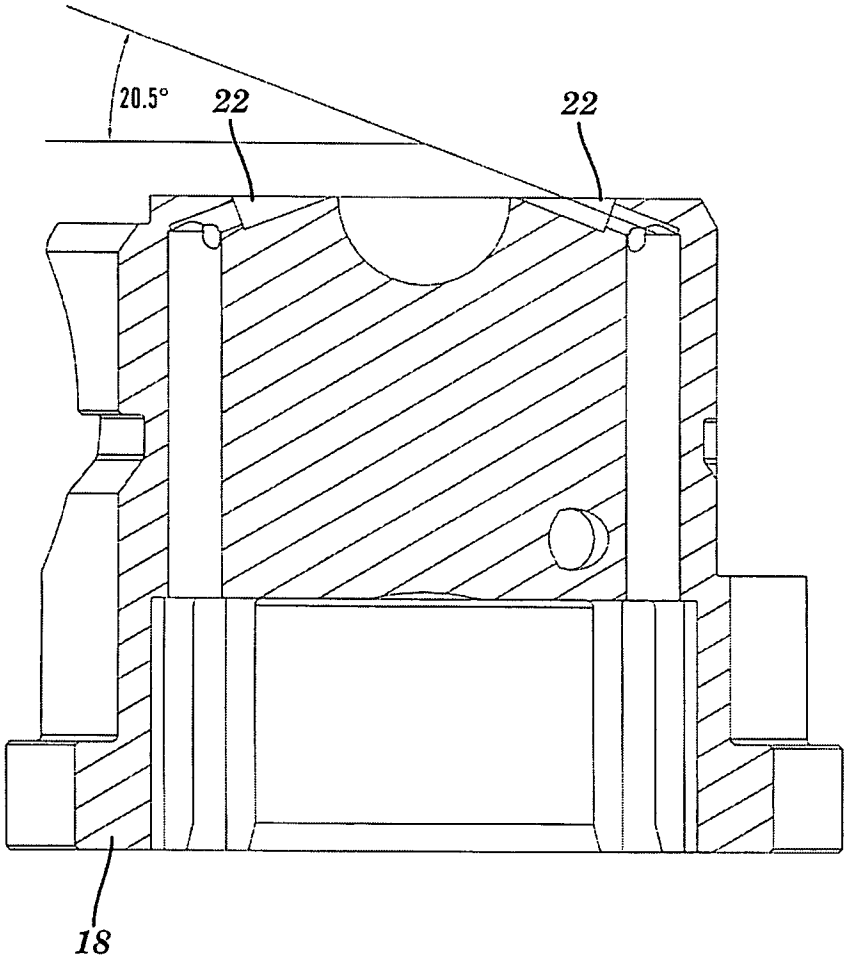
FIG. 3 is a sectional view taken along line 3-3 of FIG. 2.
Figure 4:
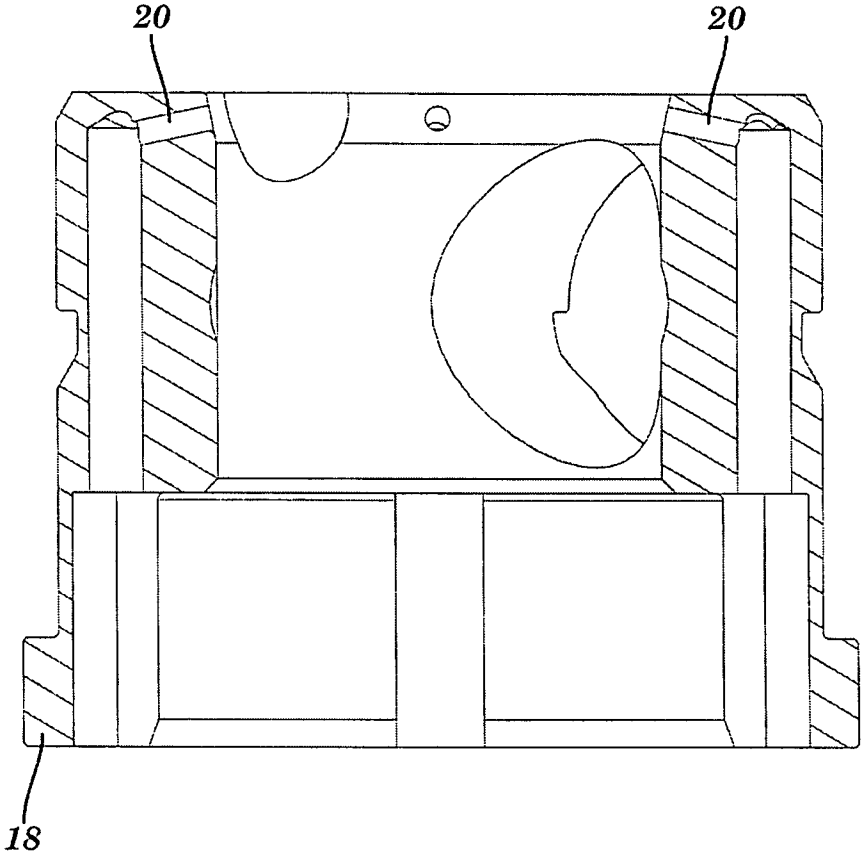
FIG. 4 is a sectional view taken along line 4-4 of FIG. 2.
Figure 5:
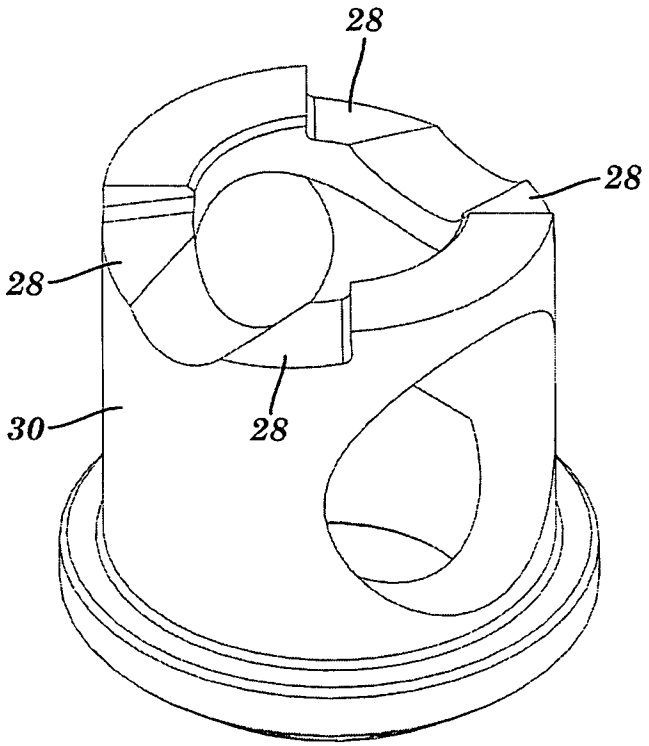
FIG. 5 is a front perspective view of the housing of the instant invention.
Figure 6:
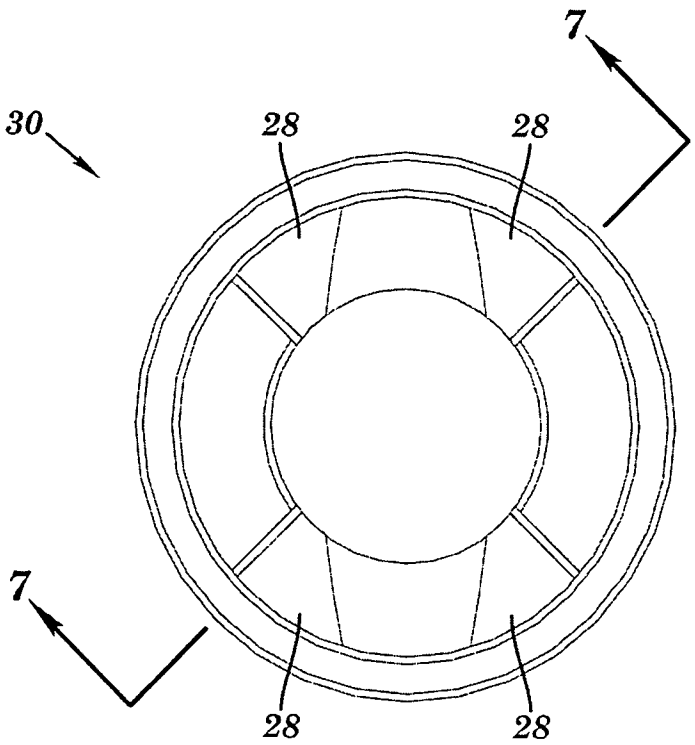
FIG. 6 is a front plan view of the housing of the instant invention.
Figure 7:
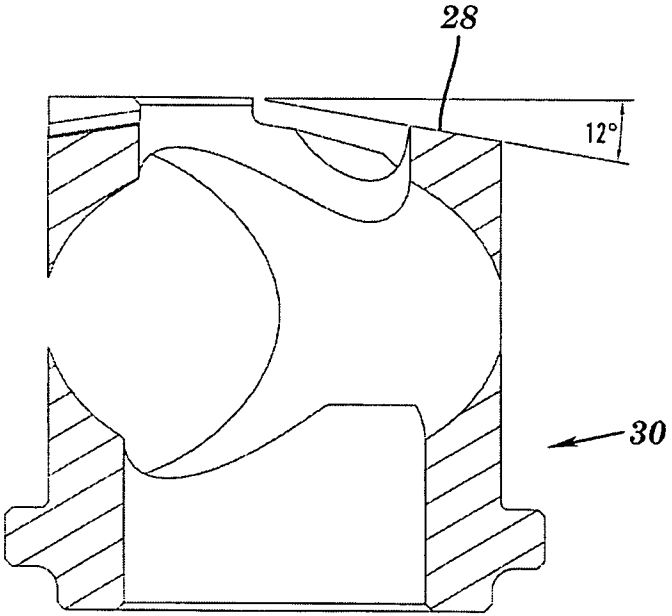
FIG. 7 is a sectional view taken along line 7-7 of FIG. 6.

The air-assisted airless spray tip assembly is generally designated 10 in FIG. 1 and is comprised of a traditional reversible tip 12 having a carbide 14 wherein the cat-eye shaped orifice 14*a* is situated so that its major dimension is perpendicular to the barrel 16. Air cap 18 is shown in more detail in FIGS. 2-4 and is provided with first and second sets of jets 20 and 22 respectively. Ramp jets 20 are direct radially inwardly toward the longitudinal axis 24 of assembly 10 and slightly forwardly at an angle of about 12° relative to a plane that is perpendicular to the longitudinal axis 24 of assembly 10.

The second set of jets 22 are directed perpendicularly to the fan 26 and spaced laterally from the longitudinal axis 24. Jets 22 are angled at about 20.5° from the plane that is perpendicular to the longitudinal axis 24 of assembly 10.

Ramp jets 20 are located so as to direct the air flow along channel ramps 28 located on the front of housing 30 which also bear an angle of about 12° relative to a plane that is perpendicular to the longitudinal axis 24 of assembly 10 so as to guide the flow to the center of the oval or cat-eye shaped orifice 14*a*.

Figure 8:
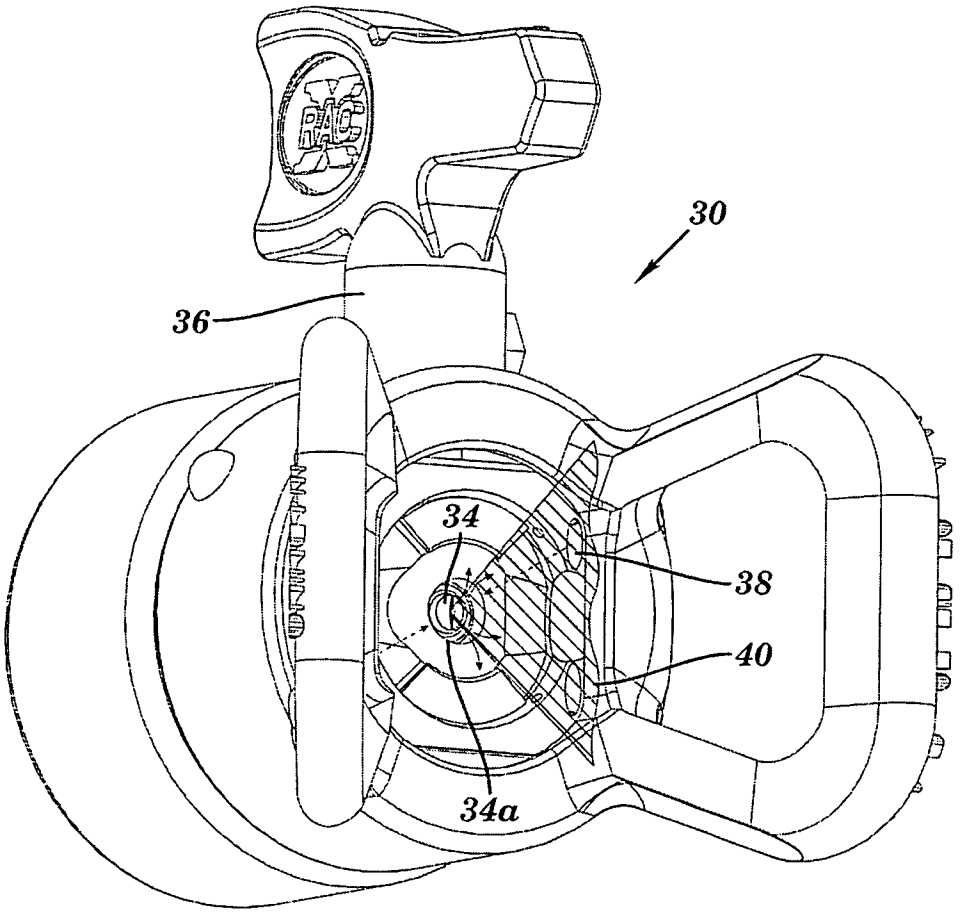
FIG. 8 is a front perspective view of an alternate embodiment of the tip assembly of the instant invention.

An alternative embodiment is shown in FIG. 8 wherein tip assembly 30 is comprised of a reversible tip 32 having a carbide 34 wherein the cat-eye shaped orifice 34*a* is situated so that its major dimension is parallel (not perpendicular as is typical in the prior art) to the barrel 36. A pair of jets 38 are directed at opposite sides of orifice 34*a*'s major dimension and perpendicular to spray fan 40.

It is contemplated that various changes and modifications may he made to the tip assembly without departing from the spirit and scope of the invention as defined by the following claims.

The invention claimed is:

1. A reversible spray tip assembly comprising:

a housing;

a barrel disposed within the housing that is rotatable about a rotation axis extending through the barrel;

a carbide airless tip having a cat-eye shaped orifice, wherein the cat-eye shaped orifice is configured to discharge a fan-shaped spray along a longitudinal axis that extends through a geometric center of the cat-eye shaped orifice and is perpendicular to the rotational axis; and an aircap that is mounted to the housing forward of the barrel, wherein the aircap comprises:

a front face with an aperture through which the fan-shaped spray discharges;

a first set of openings positioned along a periphery of the aperture to direct a first set of air jets generally inward relative to the aperture, wherein the openings of the first set of openings are oriented such that the first set of air jets converge forward of the aperture;

a second set of openings positioned on a first side of the aircap adjacent to the aperture to direct a second set of air jets along a first plane, wherein the openings of the second set of openings are oriented such that the second set of air jets converge forward of the front face; and a third set of openings positioned on a second side of the aircap that is opposite the first side to direct a third set of air jets along a second plane, wherein the openings of the third set of openings are oriented such that the third set of air jets converge forward of the front face, and wherein the first and second planes are generally perpendicular to the front face, generally parallel to one another, and adjacent to the periphery of the aperture.

2. The reversible spray tip assembly of claim 1, wherein the first set of air jets is angled forward about 12 degrees relative to the front face.

3. The reversible spray tip assembly of claim 1, wherein the first set of air jets has four air jets that are equally spaced along the periphery of the aperture.

4. The reversible spray tip assembly of claim 1, wherein the second and third sets of air jets are angled forward about 20.5 degrees from the front face.

5. The reversible spray tip assembly of claim 1, wherein the cat-eye shaped orifice has a major dimension and a minor dimension, and wherein the major dimension is generally parallel to the rotational axis of the barrel.

6. The reversible spray tip assembly of claim 1, wherein the cat-eye shaped orifice has a major dimension and a minor dimension, and wherein the major dimension is generally transverse to the rotational axis of the barrel.

* * * * *